US010797429B2

(12) United States Patent
Hsu et al.

(10) Patent No.: US 10,797,429 B2
(45) Date of Patent: Oct. 6, 2020

(54) ELECTRONIC DEVICE

(71) Applicant: PEGATRON CORPORATION, Taipei (TW)

(72) Inventors: Hsiang-Chi Hsu, Taipei (TW); Mei-Yin Yeh, Taipei (TW); I-Tien Hsieh, Taipei (TW); Hui-Chen Wang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/391,106

(22) Filed: Apr. 22, 2019

(65) Prior Publication Data

US 2019/0341717 A1 Nov. 7, 2019

(30) Foreign Application Priority Data

May 7, 2018 (TW) ..... 107115476 A

(51) Int. Cl.
*H01R 13/52* (2006.01)

(52) U.S. Cl.
CPC ..... *H01R 13/5202* (2013.01)

(58) Field of Classification Search
CPC ..... H01R 13/5202; H01R 12/722
See application file for complete search history.

(56) References Cited

U.S. PATENT DOCUMENTS 5,984,731 A * 11/1999 Laity ..... H01R 31/06 361/679.4
6,244,886 B1 * 6/2001 Strang ..... H01R 13/5202 439/271
7,611,371 B2 * 11/2009 Guo ..... H01R 13/447 439/367
8,817,462 B2 8/2014 Tsai et al.
8,917,515 B2 * 12/2014 Chu ..... H01R 13/5202 361/728

(Continued)

FOREIGN PATENT DOCUMENTS

CN 104427043 3/2015
TW M413995 10/2011

(Continued)

OTHER PUBLICATIONS

"Office Action of Taiwan Counterpart Application," dated Dec. 24, 2019, p. 1-p. 9.

*Primary Examiner* — Xuong M Chung Trans
(74) *Attorney, Agent, or Firm* — J.C. Patents

(57) ABSTRACT

An electronic device including a casing, at least one connector and a waterproof elastic module is provided. The casing includes at least one first hole. The at least one connector is disposed in the casing, the at least one connector penetrates the at least one first hole and is exposed out of the at least one first hole, and at least one gap exists between walls of the casing encircling the at least one first hole and the corresponding at least one connector. The waterproof elastic module has at least one second hole, the waterproof elastic module sleeves the at least one connector, the at least one connector is exposed out of the at least one second hole, the waterproof elastic module covers and wraps around the at least one connector, and the at least one gap is filled with the waterproof elastic module.

10 Claims, 7 Drawing Sheets

(56) References Cited

U.S. PATENT DOCUMENTS

| | | | | |
|---|---|---|---|---|
| 8,979,554 | B2 * | 3/2015 | Yudate | H01R 13/5202 439/76.1 |
| 10,109,948 | B2 | 10/2018 | Zhao et al. | |
| 2009/0009959 | A1 | 1/2009 | Cheng | |
| 2012/0181317 | A1 * | 7/2012 | Evens | G06F 1/1626 224/576 |
| 2013/0027863 | A1 | 1/2013 | Tsai et al. | |
| 2017/0288360 | A1 | 10/2017 | Zhao et al. | |

FOREIGN PATENT DOCUMENTS

| | | |
|---|---|---|
| TW | 201223002 | 6/2012 |
| TW | M447009 | 2/2013 |
| TW | M468057 | 12/2013 |
| TW | 201424145 | 6/2014 |
| TW | I444816 | 7/2014 |
| TW | 201737566 | 10/2017 |

* cited by examiner

ELECTRONIC DEVICE

CROSS-REFERENCE TO RELATED APPLICATION

This application claims the priority benefit of Taiwan application serial no. 107115476, filed on May 7, 2018. The entirety of the above-mentioned patent application is hereby incorporated by reference herein and made a part of this specification.

BACKGROUND

1. Technology Field

The present invention relates to an electronic device, and particularly relates to an electronic device with a waterproof function.

2. Description of Related Art

In general, in order to enable a connector of an electronic device to pass waterproof tests, outside moisture may be isolated by using a waterproof connector. However, the manufacture cost of a waterproof connector is high and when the connector is damaged and needs to be replaced, an identical waterproof connector must be used for replacement, and therefore, the maintenance cost is high as well.

SUMMARY

The present invention provides an electronic device, which may achieve the waterproof function of a connector with relatively low cost.

An electronic device of an embodiment of the present invention includes a casing, at least one connector and a waterproof elastic module. The casing includes at least one first hole. The at least one connector is disposed in the casing, penetrates the at least one first hole and is exposed out of the at least one first hole, and at least one gap exists between walls of the casing encircling the at least one first hole and the corresponding at least one connector. The waterproof elastic module has at least one second hole, the waterproof elastic module sleeves the at least one connector, the at least one connector is exposed out of the at least one second hole, the waterproof elastic module covers and wraps around the at least one connector, and the at least one gap is filled with the waterproof elastic module.

In one embodiment of the present invention, the waterproof elastic module includes a front portion and a first covering portion and a second covering portion which are individually connected to the front portion, and the at least one second hole is formed at the front portion, where the first covering portion and the second covering portion cover and wrap around the at least one connector therebetween.

In one embodiment of the present invention, the first covering portion and the second covering portion are suitable for being pressed to open with respect to each other and being released to close with respect to each other, so as to insert and wrap the at least one connector.

In one embodiment of the present invention, the first covering portion has a first outer surface in correspondence with one side of the at least one connector, the second covering portion has a second outer surface in correspondence with another side of the at least one connector, at least one of the first outer surface and the second outer surface has a plurality of recesses, the casing has a plurality of protrusions which are formed on the walls and have shapes corresponding to the plurality of recesses, and the plurality of protrusions are suitable for extending into the plurality of recesses so that the waterproof elastic module is fixed to the casing.

In one embodiment of the present invention, a first end portion of the first covering portion far away from the front portion and a second end portion of the second covering portion far away from the front portion abut against a circuit board, so that the waterproof elastic module covers a portion of the at least one connector connected to the circuit board.

In one embodiment of the present invention, the electronic device further includes a sealant. The sealant is disposed at portions of at least one of the first end portion and the second end portion abutting against the circuit board.

In one embodiment of the present invention, the waterproof elastic module includes at least one annular rib surrounding the at least one second hole, and the at least one annular rib abuts against a portion of the casing close to the at least one first hole.

In one embodiment of the present invention, inner surface contour and dimension of the waterproof elastic module respectively correspond to outer surface contour and dimension of the at least one connector.

In one embodiment of the present invention, the number of the at least one connector is more than one, the waterproof elastic module includes a plurality of independent waterproof elastic members, and each waterproof elastic member wraps around one connector.

In one embodiment of the present invention, the waterproof elastic module detachably sleeves the at least one connector.

In one embodiment of the present invention, the electronic device further includes an outer cover. The outer cover is disposed on the casing and suitable for selectively shielding the at least one first hole.

In one embodiment of the present invention, a side of the casing has a first surface, a second surface and a third surface which are sequentially connected to form a groove, and the at least one first hole is located in the second surface, wherein the electronic device further includes a sealing elastic member, and the sealing elastic member is suitable for abutting between the outer cover and the first surface and between the outer cover and the third surface, so as to seal the at least one first hole.

Based on the foregoing, because the gap exist between the walls of the casing encircling the first hole and the corresponding connector, according to the electronic device disclosed by the embodiment of the present invention, the waterproof elastic module sleeves the connector, and the gap between the casing and the connector is filled with the waterproof elastic module, so that the connector has a waterproof function, and furthermore moisture is isolated from entering the casing. Therefore, by the design of the waterproof elastic module, the electronic device disclosed by the embodiment of the present invention may achieve the waterproof function with a general connector, without using a relatively expensive waterproof connector, which is favorable for saving cost.

In order to make the aforementioned and other objectives and advantages of the present invention comprehensible, embodiments accompanied with figures are described in detail below.

DETAILED DESCRIPTION

Figure 1:
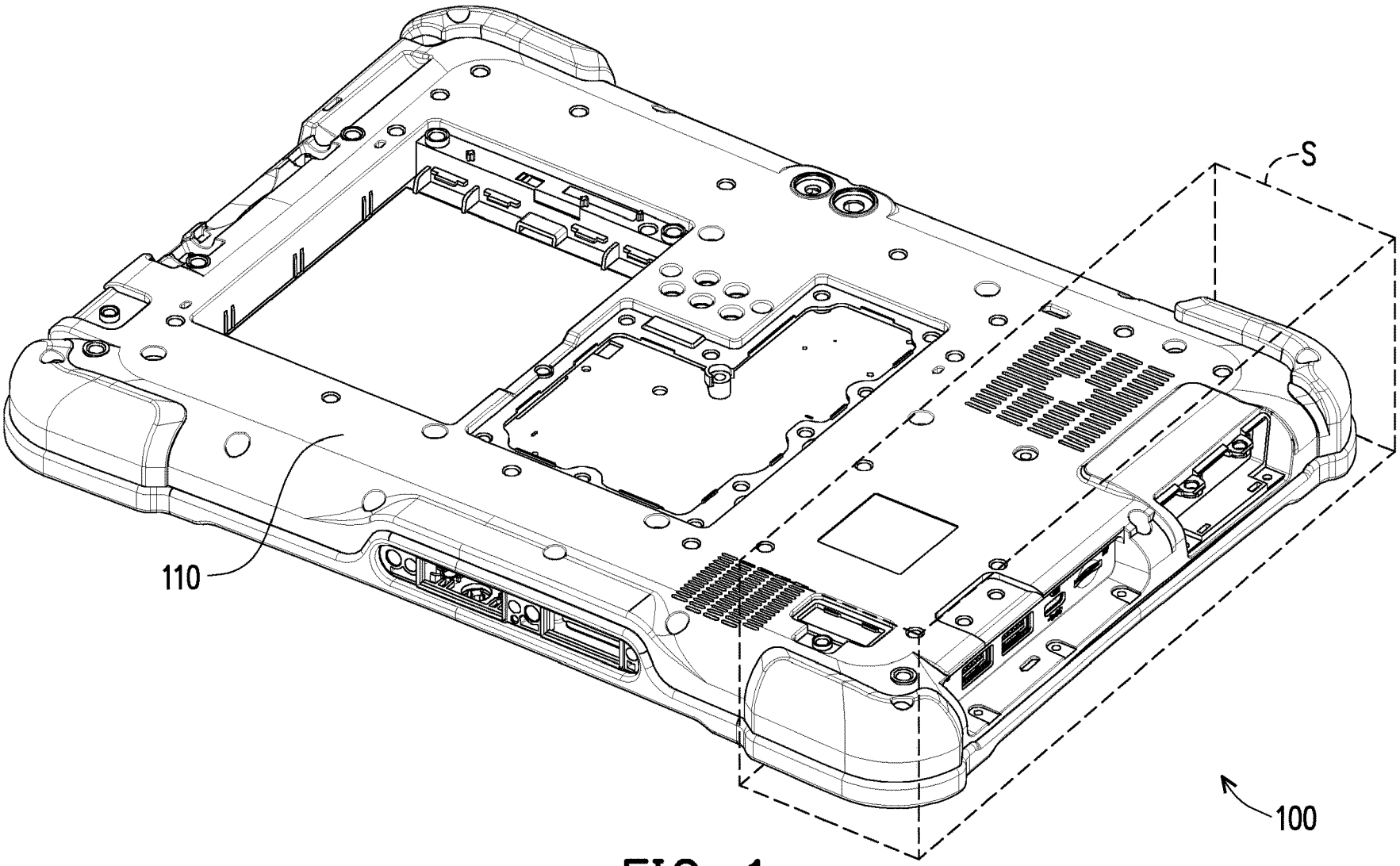
FIG. 1 is a three-dimensional schematic diagram of an electronic device according to one embodiment of the present invention.
Figure 2:
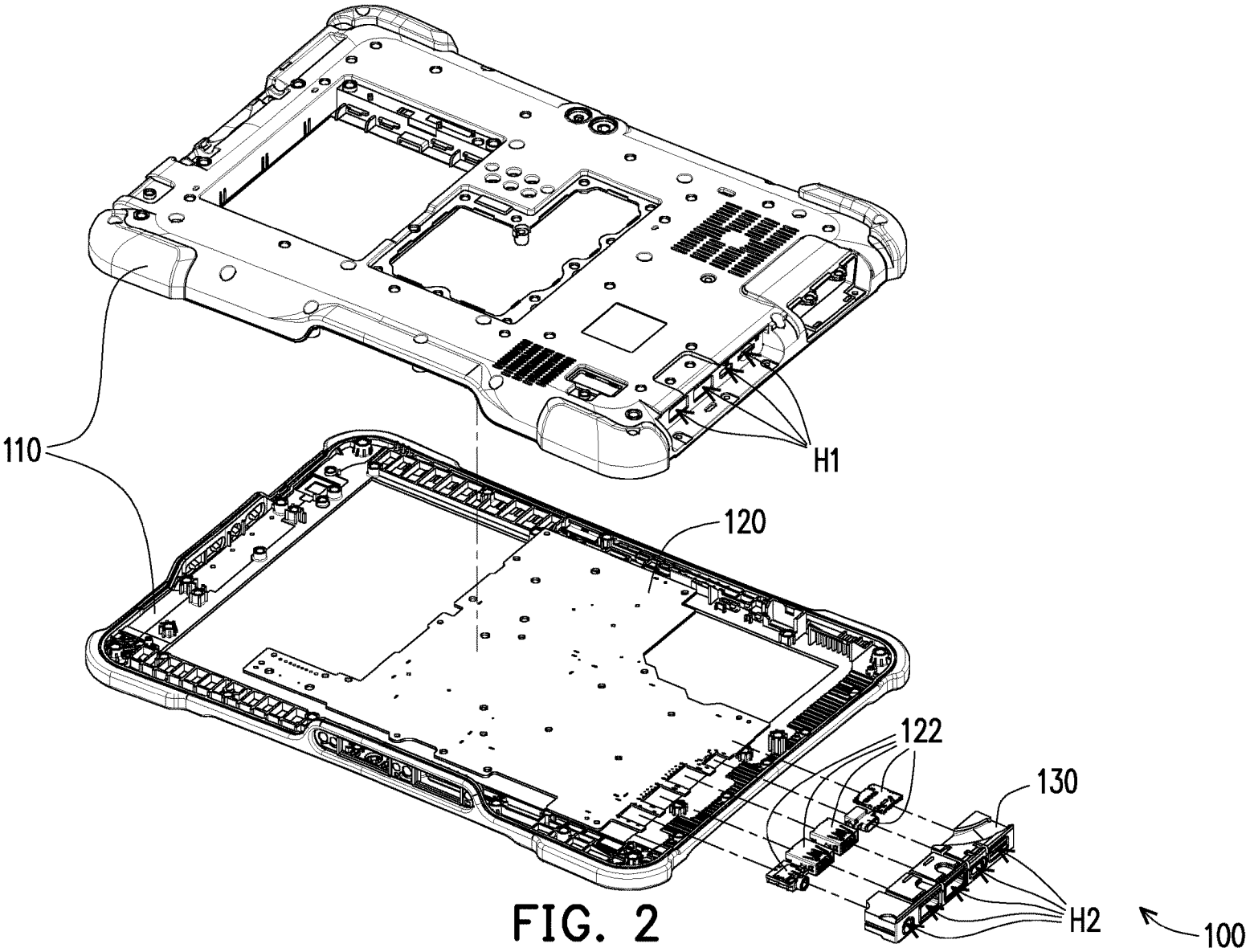
FIG. 2 is an exploded view of the electronic device of FIG. 1.
Figure 3A:
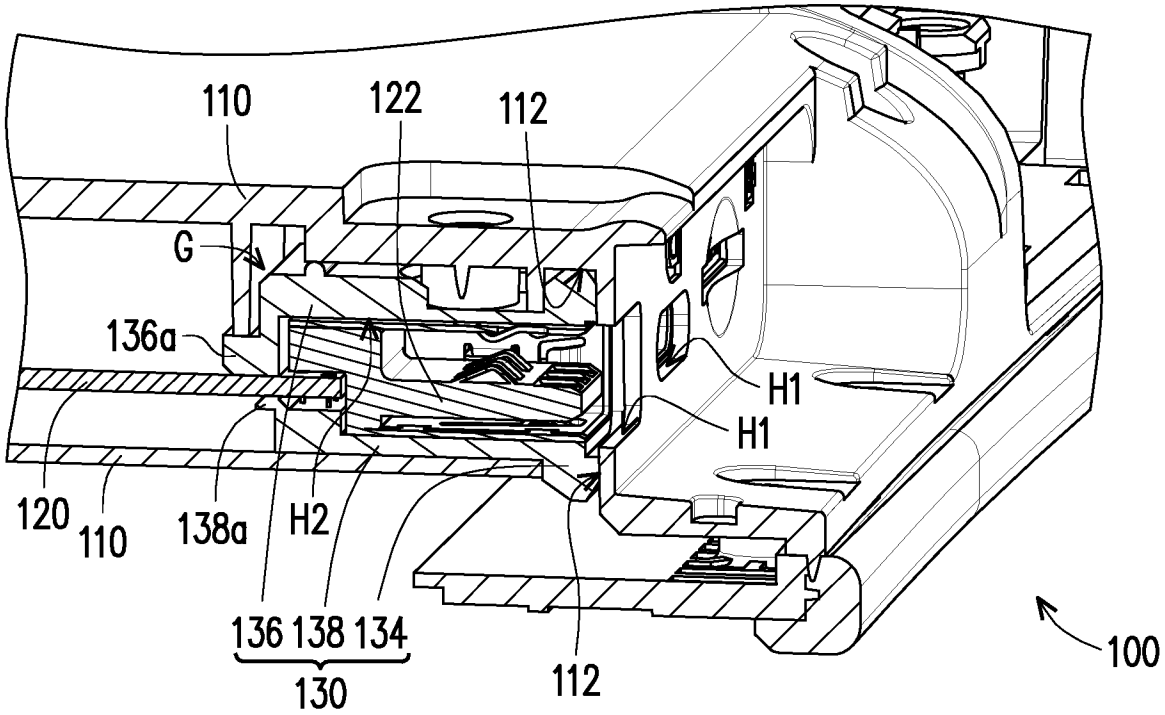
FIG. 3A and FIG. 3B are respective local cross-section views at different viewing angles of the electronic device of FIG. 1.
Figure 3B:
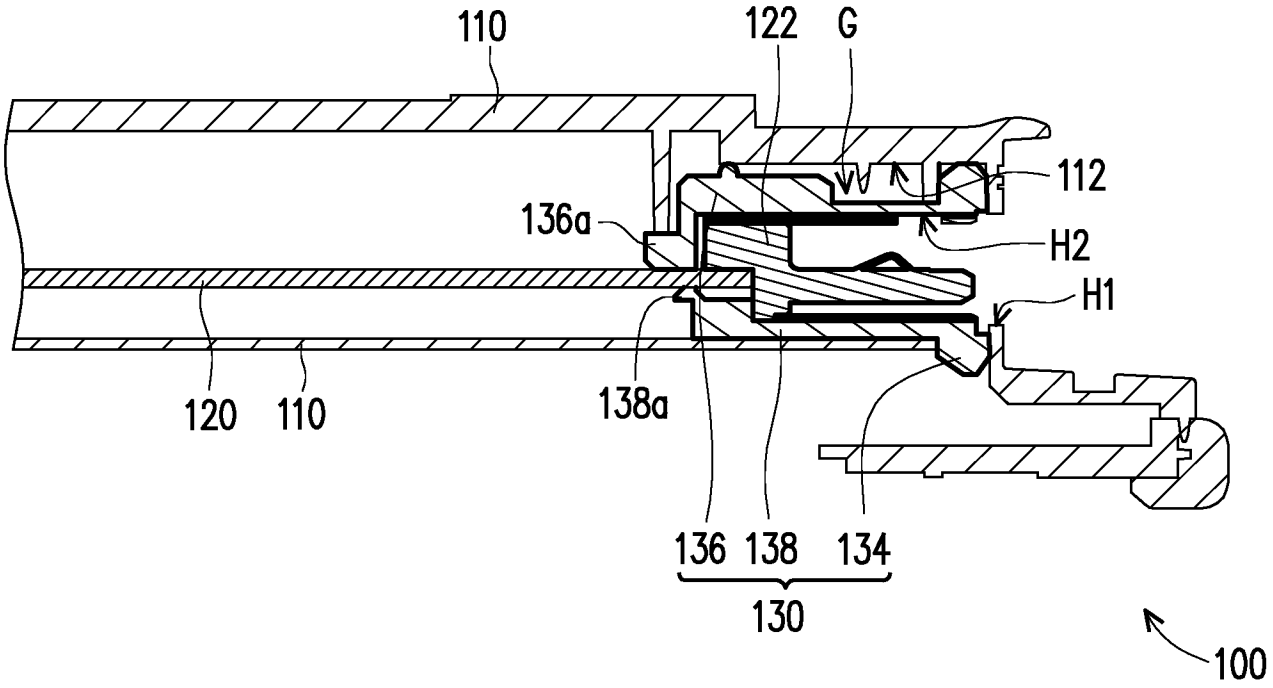

FIG. 1 is a three-dimensional schematic diagram of an electronic device according to one embodiment of the present invention. FIG. 2 is an exploded view of the electronic device of FIG. 1. FIG. 3A and FIG. 3B are respective local cross-section views at different viewing angles of the electronic device of FIG. 1. Referring to FIG. 1 to FIG. 3B, an electronic device 100 of the present embodiment includes a casing 110, at least one connector 122 and a waterproof elastic module 130. The casing 110 includes at least one first hole H1 formed at a side S of the casing 110. The at least one connector 122 is disposed in the casing 110, the at least one connector 122 penetrates the at least one first hole H1 and is exposed out of the at least one first hole H1, and at least one gap G exists between the plurality of walls 112 of the casing 110 encircling the at least one first hole H1 and the corresponding at least one connector 122. The waterproof elastic module 130 has at least one second hole H2. The waterproof elastic module 130 sleeves the at least one connector 122. The at least one connector 122 is exposed out of the at least one second hole H2. The at least one gap G is filled with the waterproof elastic module 130, where inner surface contour and dimension of the waterproof elastic module 130 correspond to outer surface contour and dimension of the at least one connector 122. In the present embodiment, the number of the first holes H1, the number of the connectors 122, the number of the second holes H2 and the number of the gaps G are five as an example. In other embodiments, the number of the first holes H1, the number of the connectors 122, the number of the second holes H2 and the number of the gaps G may be one, two or other quantities.

In the present embodiment, the waterproof elastic module 130 sleeves the connector 122, and the gap G between the casing 110 and the connector 122 is filled with the waterproof elastic module 130, so that the connector 122 has a waterproof function, and furthermore moisture is isolated from entering the casing 110. Therefore, by the design of the waterproof elastic module 130, the electronic device 100 of the present embodiment may achieve the waterproof function with a general connector, without using a relatively expensive waterproof connector, which is favorable for saving cost.

Figure 4:
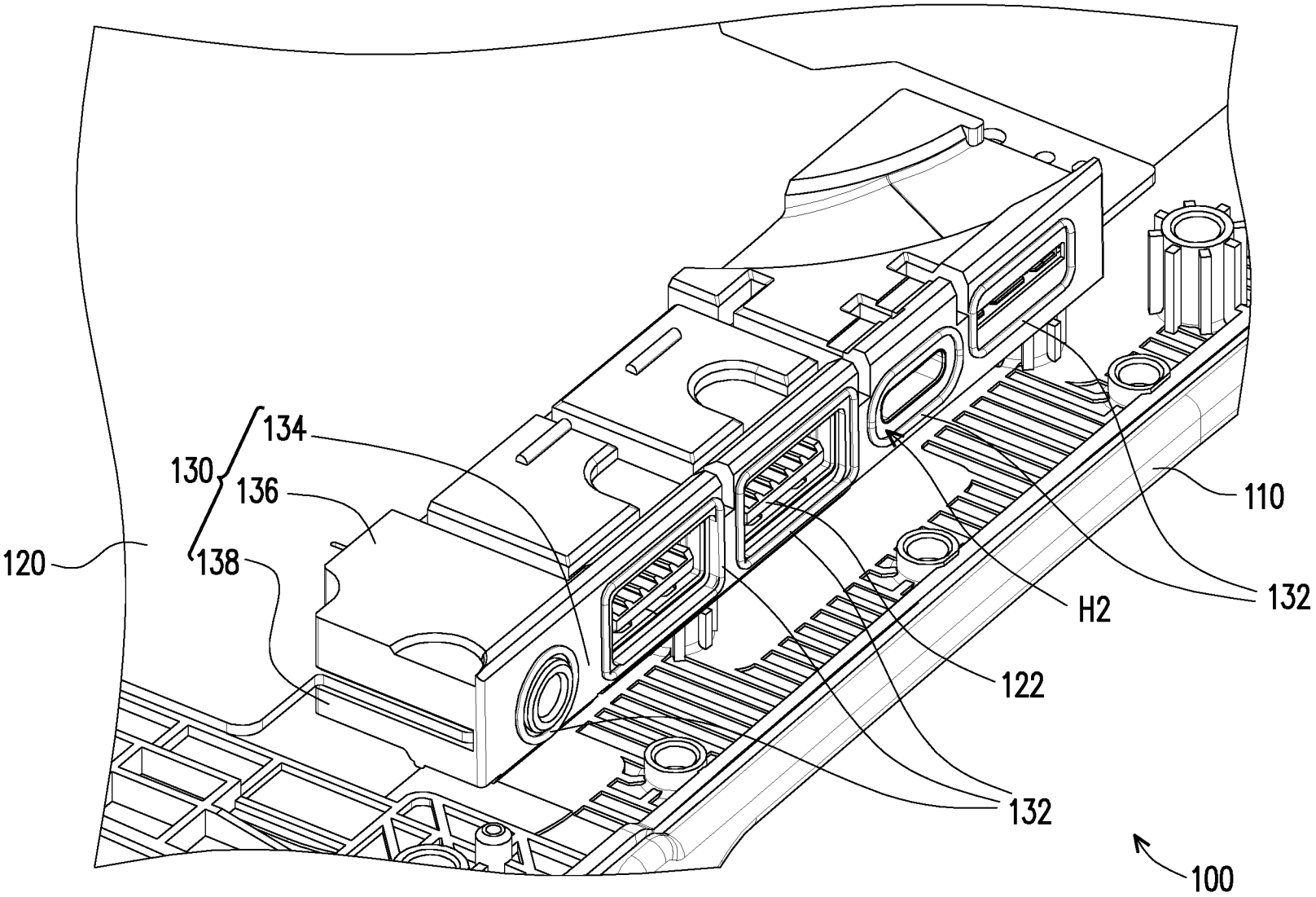
FIG. 4 is an enlarged schematic diagram of assembly of a connector and a waterproof elastic module of FIG. 2 on a casing.

FIG. 4 is an enlarged schematic diagram of the connector and the waterproof elastic module of FIG. 2 assembled on the casing. In FIG. 4, a portion of the casing located above the connector 122 and the waterproof elastic module 130 are not shown for clarity. Referring to FIG. 3A to FIG. 4, the waterproof elastic module 130 of the present embodiment has at least one annular rib 132 (indicated in FIG. 4) surrounding the at least one second hole H2, and the at least one annular rib 132 abuts against a portion of the casing 110 close to the at least one first hole H1. In the present embodiment, the number of the annular ribs 132 is five as an example. In other embodiments, the number of the annular ribs 132 may be one, two or other quantities. Because the annular ribs 132 encircle the second holes H2 and abut against the casing 110, moisture may be further isolated from entering the gap G between the casing 110 and the connector 122, so as to boost the waterproof effect of the waterproof elastic module 130.

In the present embodiment, the waterproof elastic module 130 includes a front portion 134 and a first covering portion 136 and a second covering portion 138 which are individually connected to the front portion 134, and the second holes H2 are formed in the front portion 134, where the first covering portion 136 and the second covering portion 138 are suitable for being opened or closed with respect to each other so as to wrap the connector 122 in between. In detail, the first covering portion 136 and the second covering portion 138 of the waterproof elastic module 130 have flexibility, and therefore, in an assembling process, the first covering portion 136 and the second covering portion 138 are suitable for being pressed to open widely with respect to each other so as to insert the connectors 122 therebetween, and then the first covering portion 136 and the second covering portion 138 are released to close relative to each other, so as to cover and wrap the connectors 122 in between. For example, when sections of the first covering portion 136 and the second covering portion 138 close to the front portion 134 are pressed in a vertical direction, two ends of the first covering portion 136 and the second covering portion 138 far away from the front portion 134 may open widely with respect to each other, and at the moment, the connectors 122 may be inserted in between. After the pressure is released, the two ends of the first covering portion 136 and the second covering portion 138 far away from the front portion 134 return to a closed state, and at the moment, the first covering portion 136 and the second covering portion 138 cover and wrap around the connectors 122.

In addition, a first end portion 136*a* of the first covering portion 136 far away from the front portion 134 and a second end portion 138*a* of the second covering portion 138 far away from the front portion 134 abut against a circuit board 120, so that the waterproof elastic module 130 covers the portions of the connectors 122 connected to the circuit board 120.

In other embodiments, the waterproof elastic module 130 may be of other forms, for example, an elastic sleeve directly sleeves the connectors 122. In addition, the waterproof elastic module 130 of the present embodiment is an integrally formed structure. However, in other embodiments (not shown), the waterproof elastic module 130 may include a plurality of independent waterproof elastic members, and each waterproof elastic member wraps around one of the connectors, and the present invention is not limited to this.

In the present embodiment, the waterproof elastic module 130 detachably sleeves the connector 122. When any one of connectors 122 is damaged and needs to be replaced, the first covering portion 136 and the second covering portion 138 may be directly opened widely with respect to each other, so that the waterproof elastic module 130 is separated from the connector 122, which may be convenient for maintenance and replacement of components.

Figure 5:
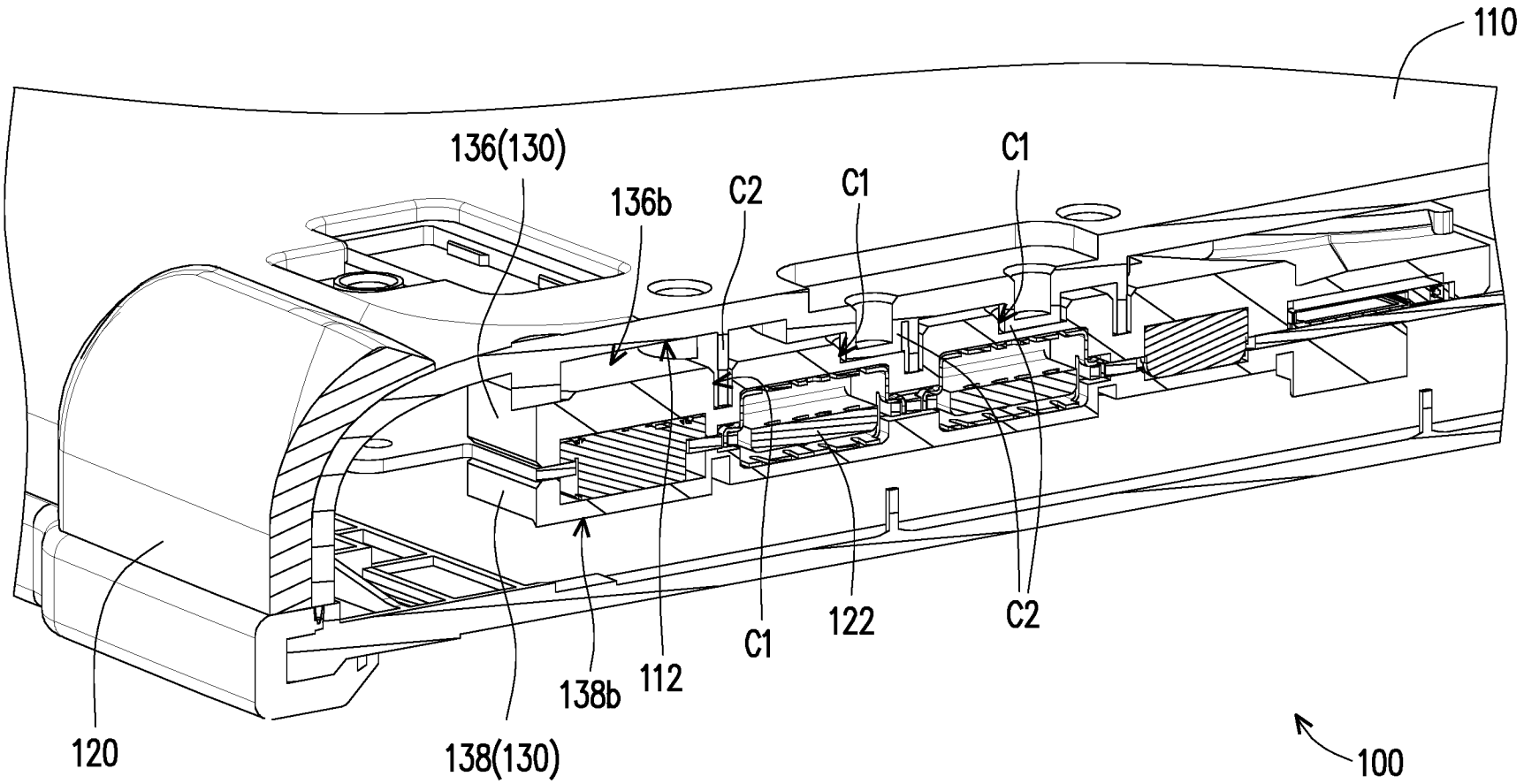
FIG. 5 is a local schematic cross-section view of another cross section of the electronic device of FIG. 1.

FIG. 5 is a local schematic cross-section view of another cross section of the electronic device of FIG. 1. Referring to FIG. 5, the first covering portion 136 of the present embodiment has a first outer surface 136*b* in correspondence with one side of the connector 122. The second covering portion 138 has a second outer surface 138*b* in correspondence with another side of the connector 122. At least one of the first outer surface 136*b* and the second outer surface 138*b* has a plurality of recesses C1. The casing 110 has a plurality of protrusions C2 which are formed on the walls 112 and have shapes corresponding to the recesses C1. The protrusions C2 are suitable for extending into the recesses C1 so that the waterproof elastic module 130 is fixed to the casing 110. In the present embodiment, the first outer surface 136*b* has the plurality of recesses C1. In other embodiments, the second outer surface 138*b* may have the plurality of recesses C1, or both the first outer surface 136*b* and the second outer surface 138*b* have the plurality of recesses C1, and the present invention is not limited thereto.

Figure 6:
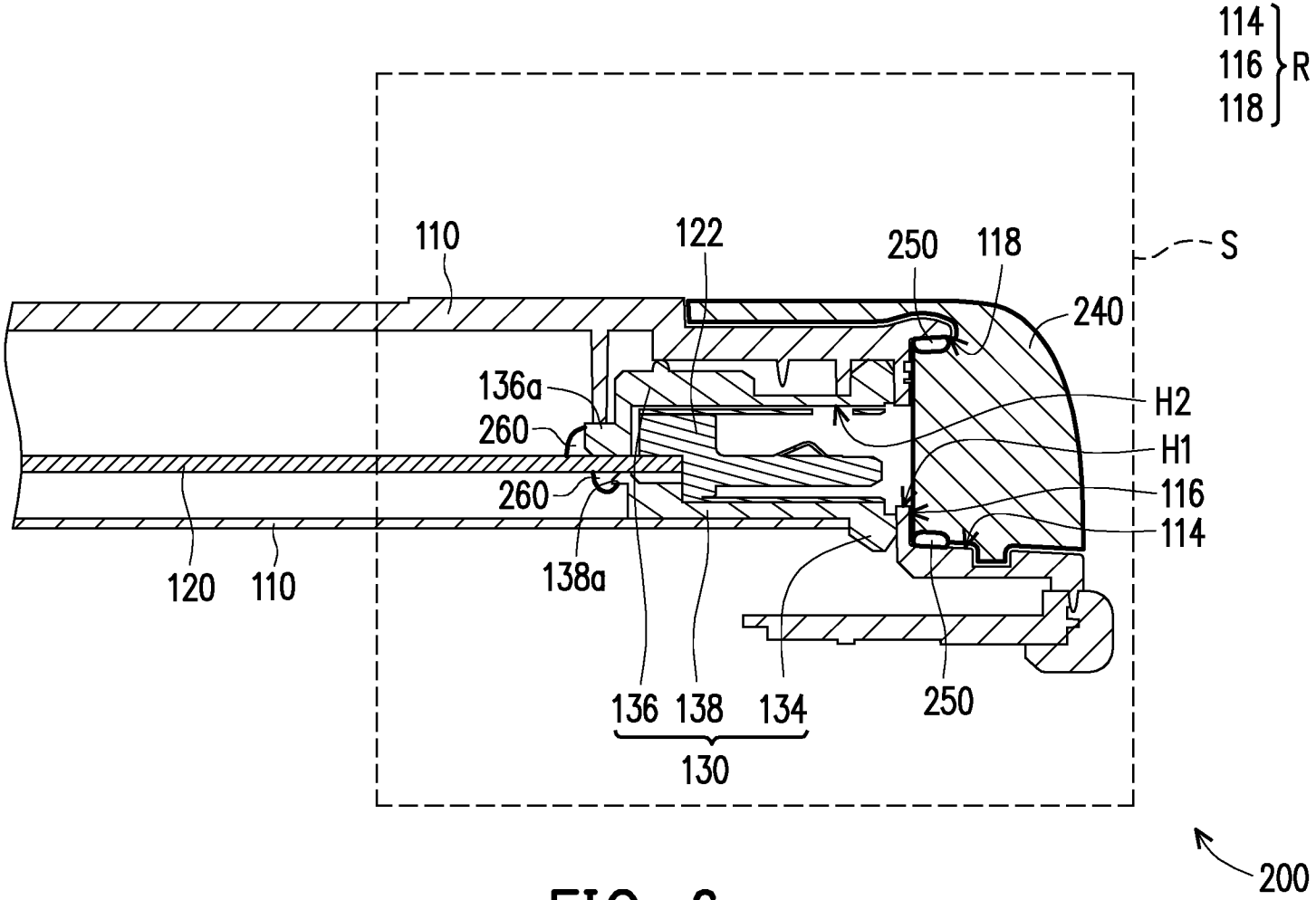
FIG. 6 is a local schematic cross-section view of an electronic device according to another embodiment of the present invention.

FIG. 6 is a local schematic cross-section view of an electronic device according to another embodiment of the present invention. Referring to FIG. 6, an electronic device 200 of FIG. 6 is similar to the electronic device 100 of the foregoing embodiment, and the main difference is that the electronic device 200 of FIG. 6 further includes an outer cover 240, which is disposed on the casing 110 and suitable for selectively shielding the at least one first hole H1. In detail, the side S of the casing 110 has a first surface 114, a second surface 116 and a third surface 118 which are sequentially connected to form a groove R, and the first hole H1 is located at the second surface 116, wherein the electronic device 200 further includes a sealing elastic member 250, and the sealing elastic member 250 is suitable for abutting between the outer cover 240 and the first surface 114 and between the outer cover 240 and the third surface 118, so as to seal the first hole H1.

Moreover, the electronic device 200 of the present embodiment further includes a sealant 260, which is disposed at the portions of at least one of the first end portion 136*a* and the second end portion 138*a* abutting against the circuit board 120. In the present embodiment, the sealant 260 is disposed at the portions of the first end portion 136*a* and the second end portion 138*a* abutting against the circuit board 120. In other embodiments, the sealant 260 may be only disposed at the portion of the first end portion 136*a* abutting against the circuit board 120, or the sealant 260 may be only disposed at the portion of the second end portion 138*a* abutting against the circuit board 120, and the present invention is not limited thereto.

Based on the foregoing, the electronic device 200 of the present embodiment adopts three designs for boosting the waterproof effect. In the first design, the outer cover 240 and the sealing elastic member 250 are adopted to seal the first hole H1, so as to serve as the first enhanced protection. In the second design, the annular ribs 132 surrounding the second holes H2 are adopted to abut against the casing 110, so as to serve as the second enhanced protection. In the third design, the sealant 260 is adopted to seal the portions of the first end portion 136*a* and the second end portion 136*b* of the waterproof elastic module 130 abutting against the circuit board 120, so as to serve as the third enhanced protection. By the abovementioned three designs, moisture may be further isolated from entering the casing 110, so as to boost the waterproof effect of the electronic device 200. However, in other embodiments, the electronic device 200 may adopt any one or any two of the abovementioned three designs, which may also achieve the effect of isolating moisture.

To sum up, because the gaps exist between the walls of the casing encircling the first hole and the corresponding connector, according to the electronic device of the embodiment of the present invention, the waterproof elastic module sleeves the connector, and the gap between the casing and the connector is filled with the waterproof elastic module, so that the connector has the waterproof function, and moisture is further isolated from entering the casing. Therefore, by the design of the waterproof elastic module, the electronic device of the embodiment of the present invention may achieve the waterproof function with a general connector, without using a relatively expensive waterproof connector, which is favorable for saving cost.

Although the present invention has been disclosed above through the embodiments, the embodiments are not intended to limit the present invention, any person of ordinary skill in the art can make some alternations and modifications without departing from the spirit and scope of the present invention, and therefore, the protection scope of the present invention should be subject to the appended claims.

What is claimed is:

1. An electronic device, comprising:

a casing, comprising at least one first hole;

at least one connector, disposed in the casing, wherein the at least one connector penetrates the at least one first hole and is exposed out of the at least one first hole, and at least one gap exists between walls of the casing encircling the at least one first hole and the corresponding at least one connector; and a waterproof elastic module, comprising at least one second hole, wherein the waterproof elastic module sleeves the at least one connector, the at least one connector is exposed out of the at least one second hole, the waterproof elastic module covers and wraps around the at least one connector, and the at least one gap is filled with the waterproof elastic module, wherein the waterproof elastic module comprises a front portion and a first covering portion and a second covering portion which are individually connected to the front portion, and the at least one second hole is formed at the front portion, wherein the first covering portion and the second covering portion cover and wrap around the at least one connector therebetween, and a first end portion of the first covering portion far away from the front portion and a second end portion of the second covering portion far away from the front portion abut against a circuit board, so that the waterproof elastic module covers a portion of the at least one connector connected to the circuit board.

2. The electronic device according to claim 1, wherein the first covering portion and the second covering portion are suitable for being pressed to open with respect to each other and being released to close with respect to each other, so as to insert and wrap the at least one connector.

3. The electronic device according to claim 1, wherein the first covering portion comprises a first outer surface in correspondence with one side of the at least one connector, the second covering portion comprises a second outer surface in correspondence with another side of the at least one connector, at least one of the first outer surface and the second outer surface comprises a plurality of recesses, the casing comprises a plurality of protrusions which are formed on the walls and have shapes corresponding to the plurality of recesses, and the plurality of protrusions are suitable for extending into the plurality of recesses so that the waterproof elastic module is fixed to the casing.

4. The electronic device according to claim 1, further comprising a sealant, wherein the sealant is disposed at portions of at least one of the first end portion and the second end portion abutting against the circuit board.

5. The electronic device according to claim 1, wherein the waterproof elastic module comprises at least one annular rib surrounding the at least one second hole, and the at least one annular rib abuts against a portion of the casing close to the at least one first hole.

6. The electronic device according to claim 1, wherein inner surface contour and dimension of the waterproof elastic module correspond to outer surface contour and dimension of the at least one connector.

7. The electronic device according to claim 1, wherein the number of the at least one connector is more than one, the waterproof elastic module comprises a plurality of independent waterproof elastic members, and each waterproof elastic member wraps around one connector.

8. The electronic device according to claim 1, wherein the waterproof elastic module detachably sleeves the at least one connector.

9. The electronic device according to claim 1, further comprising an outer cover, wherein the outer cover is disposed on the casing and suitable for selectively shielding the at least one first hole.

10. The electronic device according to claim 9, wherein a side of the casing comprises a first surface, a second surface and a third surface which are sequentially connected to form a groove, and the at least one first hole is located in the second surface, wherein the electronic device further comprises a sealing elastic member, and the sealing elastic member is suitable for abutting between the outer cover and the first surface and between the outer cover and the third surface, so as to seal the at least one first hole.

* * * * *